US009082563B2

(12) United States Patent
Hasegawa et al.

(10) Patent No.: US 9,082,563 B2
(45) Date of Patent: Jul. 14, 2015

(54) POWER BREAKER

(75) Inventors: Hiroshi Hasegawa, Chiyoda-ku (JP); Takakazu Inoue, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 318 days.

(21) Appl. No.: 13/580,608

(22) PCT Filed: Mar. 8, 2010

(86) PCT No.: PCT/JP2010/001591

§ 371 (c)(1),
(2), (4) Date: Aug. 22, 2012

(87) PCT Pub. No.: WO2011/111086

PCT Pub. Date: Sep. 15, 2011

(65) Prior Publication Data

US 2012/0312667 A1 Dec. 13, 2012

(51) Int. Cl.

*H01H 3/60* (2006.01)
*H01H 33/662* (2006.01)
*H01H 33/666* (2006.01)

(52) U.S. Cl.

CPC ..... *H01H 3/60* (2013.01); *H01H 33/66207* (2013.01); *H01H 33/666* (2013.01)

(58) Field of Classification Search

CPC ..... H01H 33/42; H01H 33/66
USPC ..... 218/7–10, 118–120, 140, 152–154
See application file for complete search history.

(56) References Cited

U.S. PATENT DOCUMENTS

| | | | | |
|---|---|---|---|---|
| 3,673,359 | A * | 6/1972 | Wickman | 200/19.01 |
| 4,099,039 | A * | 7/1978 | Barkan | 218/140 |
| 2008/0047819 | A1 * | 2/2008 | Takahara et al. | 200/540 |

FOREIGN PATENT DOCUMENTS

| | | | |
|---|---|---|---|
| CN | 86209155 | U | 9/1987 |
| EP | 0704872 | A1 | 4/1996 |
| JP | 56-148841 | U | 11/1981 |
| JP | 59-130347 | U | 9/1984 |

(Continued)

OTHER PUBLICATIONS

International Search Report (PCT/ISA/210) issued on Apr. 13, 2010, by the Japanese Patent Office as the International Searching Authority for International Application No. PCT/JP2010/001591.

(Continued)

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

A power breaker includes a fine motion mechanism portion having a chattering suppression portion formed of ring members and a ring member provided with sloping surfaces or curved surfaces at positions corresponding to one another in a state stacked up in a center axis direction, so that an impact generated upon collision of a movable electrode with a fixed electrode when a circuit is closed is trapped as a compression force. Hence, kinetic energy generated upon collision is consumed by energy absorption by friction due to a spring property of the ring members and a frictional force on the contact surfaces. It thus becomes possible to reduce a generation time of a chattering action.

7 Claims, 12 Drawing Sheets

(56) References Cited

FOREIGN PATENT DOCUMENTS

| | | | |
|---|---|---|---|
| JP | 05-190063 | A | 7/1993 |
| JP | 2004-222390 | A | 8/2004 |
| JP | 2006-269202 | A | 10/2006 |

OTHER PUBLICATIONS

Chinese Office Action dated Jun. 4, 2014 issued in corresponding Chinese Patent Appln. No. 201080065270.0 (8 pages).

* cited by examiner

POWER BREAKER

TECHNICAL FIELD

The present invention relates to a power breaker, and more particularly, to a power breaker, such as a vacuum circuit breaker (VCB) in which a fixed electrode and a movable electrode allowed to come into contact with and separate from each other are brought into contact with each other by pressing one main contact against the other main contact in a movable direction.

BACKGROUND ART

There is a power breaker in the related art having a butt structure by which a fixed electrode and a movable electrode are abutted against each other, for example, as in a vacuum circuit breaker (VCB). Such a breaker becomes conductive when the both electrodes are brought into contact with each other by abutting respective main contacts against each other.

The butt structure, however, may possibly give rise to chattering of the contacts when the circuit is closed upon collision of the both electrodes with a circuit closing speed.

Patent Document 1 discloses a configuration to suppress the chattering. More specifically, "a member having a slope" is provided to vacuum switch tubes (VST) on a fixed terminal side and "a member having a pair of slopes pressed by a spring" against the firstly-mentioned slope is allowed to slide on this slope.

According to this configuration, kinetic energy a movable-end contact holds during a circuit closing operation of the vacuum circuit breaker (VCB) is converted to frictional energy between the both members and thereby caused to disappear. Hence, chattering is suppressed.

RELATED ART DOCUMENT

Patent Document

Patent Document 1: JP-A-2006-269202 (Paragraph 0015, FIG. 3)

OUTLINE OF THE INVENTION

Problems to be Solved by the Invention

However, the power breaker in the related art is of the complex configuration involving a large number of components as described above. Hence, it takes a time to adjust alignment of the both slope members. The power breaker in the related art therefore has problems that the component cost and the assembly cost are high.

The invention is devised to solve the problems discussed above and has an object to provide a compact, inexpensive power breaker that prevents chattering caused by an impact during a circuit closing operation without increasing the number of components.

Means for Solving the Problems

A power breaker of the invention includes: a switch portion formed of a fixed electrode and a movable electrode provided so that the movable electrode is allowed to come into contact with and separate from the fixed electrode; a movable shaft extending from the movable electrode; an operation mechanism closing and opening the switch portion by driving the movable shaft; a frame holding the switch portion and the movable shaft inside; and a fine motion mechanism provided with a chattering suppression portion formed of two or more ring members in contact with each other on sloping surfaces or curved surfaces formed at positions corresponding to each another in a state stacked up in a central axis direction and formed in a driving direction of the movable electrode on a side of a surface of the fixed electrode fixed to the frame opposite to a surface with and from which the movable electrode comes into contact and separates, and trapping a force generated upon collision of the movable electrode with the fixed electrode during a circuit closing operation in the chattering suppression portion as a compression force.

Advantage of the Invention

According to the invention, the fine motion mechanism portion has the chattering suppression portion formed by stacking up plural ring members having corresponding slope shapes or curved surface shapes in stacked portions. Kinetic energy generated upon collision can be absorbed by trapping the kinetic energy as a compression force due to the spring property developed by contraction and expansion of the ring members in a radial direction and a frictional force on the slope surfaces. It thus becomes possible to suppress chattering with a simple, compact and inexpensive configuration.

MODE FOR CARRYING OUT THE INVENTION

Hereinafter, various embodiments of a power breaker of the invention will be described in accordance with the drawings.

Embodiments

Figure 1:
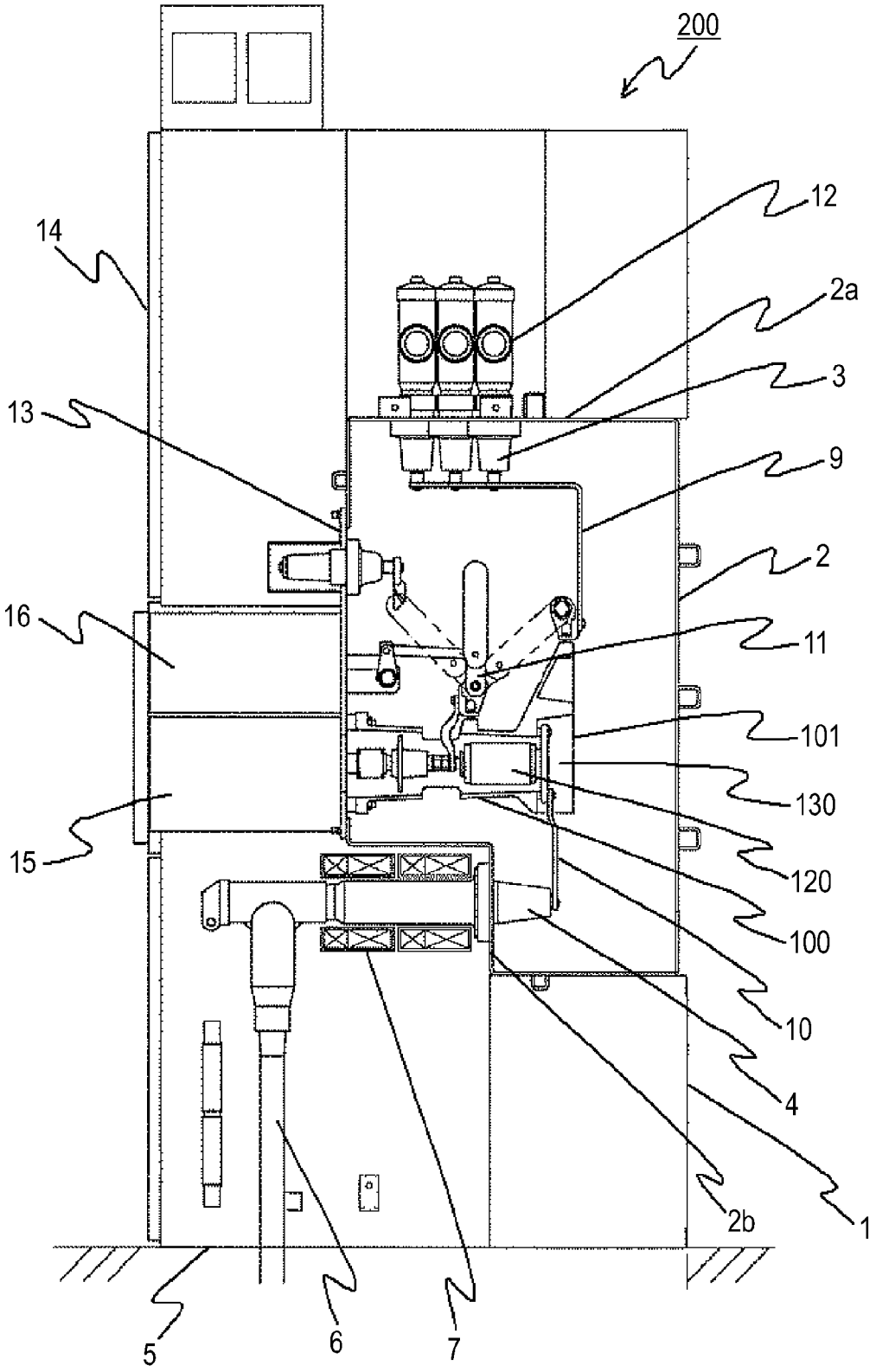
FIG. 1 is a longitudinal cross section showing an overall configuration of a gas-insulated switchgear according to one embodiment of a power breaker of the invention.

FIG. 1 is a cross section showing an overall configuration of a gas-insulated switchgear to which a power breaker according to one embodiment of the invention is applied.

As is shown in FIG. 1, a main circuit of the gas-insulated switchgear 200 is formed of a cable 6, a current detector 7, a cable bushing 4, a connecting member 10, breakers 100 as the power breaker, power disconnecting and grounding switches 11, a connecting member 9, a bus bushing 3, and buses 12.

Referring to FIG. 1, a breaker tank 2 filled with an insulating gas, such as a $SF_6$ gas, is supported on a mount 1. The three-phase bus bushing 3 is provided to an upper endplate portion 2*a* of the breaker tank 2, and one bus 12 is connected to each phase of the bus bushing 3.

The cable bushing 4 is provided to a lower end plate portion 2*b* of the breaker tank 2. The three-phase cable 6 is provided to a base 5 and each phase of the three-phase cable 6 is connected to the cable bushing 4 via the current detector 7.

Three breakers 100 each electrically connecting and disconnecting the corresponding bus 12 and the cable 6 are housed side by side inside the breaker tank 2. Each breaker 100 has an insulating frame 101 fixed to a mounting plate 13 and a vacuum valve 120 as a breaker arc-extinguishing chamber held inside the insulating frame 101.

Also, three power disconnecting and grounding switches 11 each electrically connecting and disconnecting the corresponding breaker 100 and bus 12 are housed side by side inside the breaker tank 2.

Each breaker 100 is connected to one end of the corresponding power disconnecting and grounding switch 11 from a movable electrode side of the vacuum valve 120. The other end of the power disconnecting and grounding switch 11 is connected to the corresponding bus bushing 3 via the connecting member 9.

Also, each breaker 100 is connected to the cable bushing 4 from a fixed electrode side of the vacuum valve 120 via the connecting member 10.

A breaker operation mechanism 15, a disconnector operation mechanism 16, and a control unit (not shown) are housed in a housing 14. The breaker operation mechanism 15 and the disconnector operation mechanism 16 are mounted on the mounting plate 13 and supported thereon.

Figure 2:
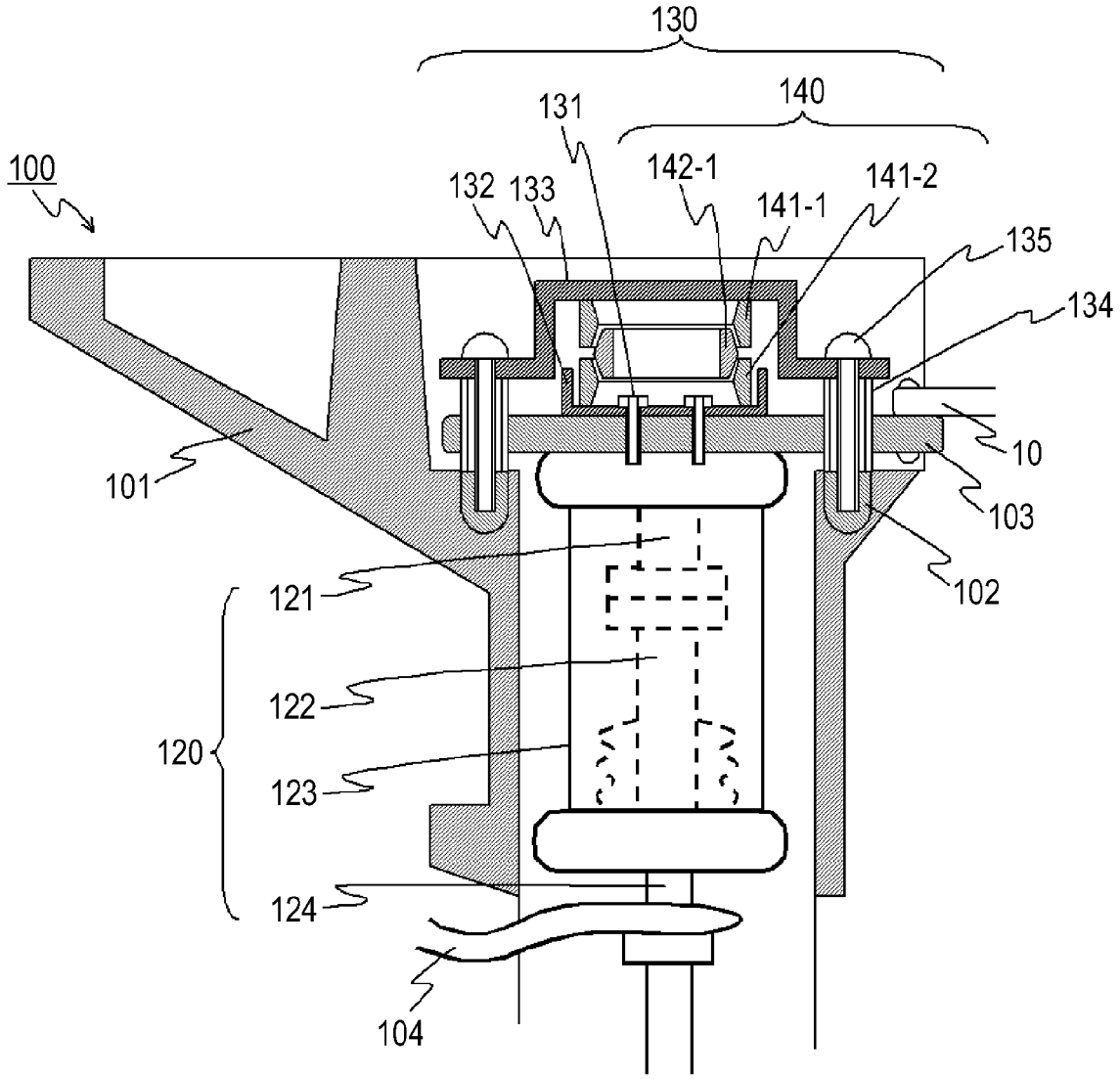
FIG. 2 is a sectional side view showing a configuration of a breaker according to one embodiment of the power breaker of the invention.

FIG. 2 is an enlarged sectional side view showing a configuration in the vicinity of the vacuum valve 120 of the breaker 100 according to one embodiment of the invention. Referring to FIG. 2, the vacuum valve 120 is formed of a fixed electrode 121, a movable electrode 122, a vacuum switch portion 123 covering the fixed electrode 121 and the movable electrode 122 forming a switch portion, and an operation bar conductor 124 as a movable shaft that drives the movable electrode 122 to come into contact with and separate from the fixed electrode 121.

The vacuum valve 120 is fixed to a supporting conductor 103 on the side of the fixed electrode 121. The supporting conductor 103 is provided with a fine motion mechanism 130 in a movable direction of the movable electrode 122 on a surface opposite to a surface onto which the vacuum valve 120 is fixed.

The fine motion mechanism 130 is provided to absorb kinetic energy generated when the movable electrode 122 comes into collision and contact with the fixed electrode 121 during a circuit closing operation.

The vacuum valve 120 is configured in such a manner that the fixed electrode 121 is connected to the connecting member 10 via the supporting conductor 103 while the movable electrode 122 is connected to the power disconnecting and grounding switch 11 via a movable-end circuit conductor 104, which is a flexible conductor, and performs circuit opening and closing operations.

Figure 3:
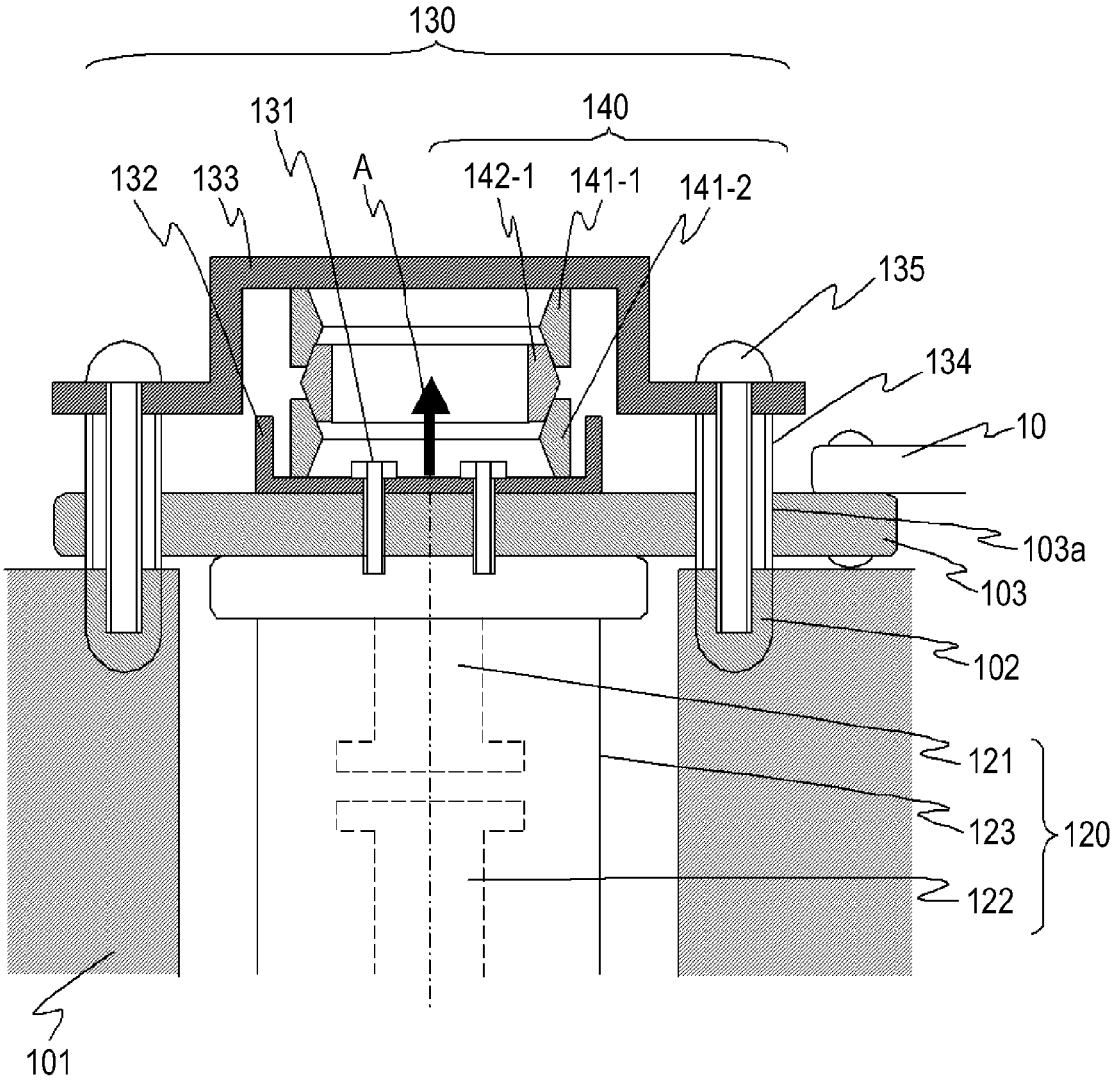
FIG. 3 is an enlarged sectional side view showing a configuration of a fine motion mechanism according to one embodiment of the power breaker of the invention.
Figure 4:
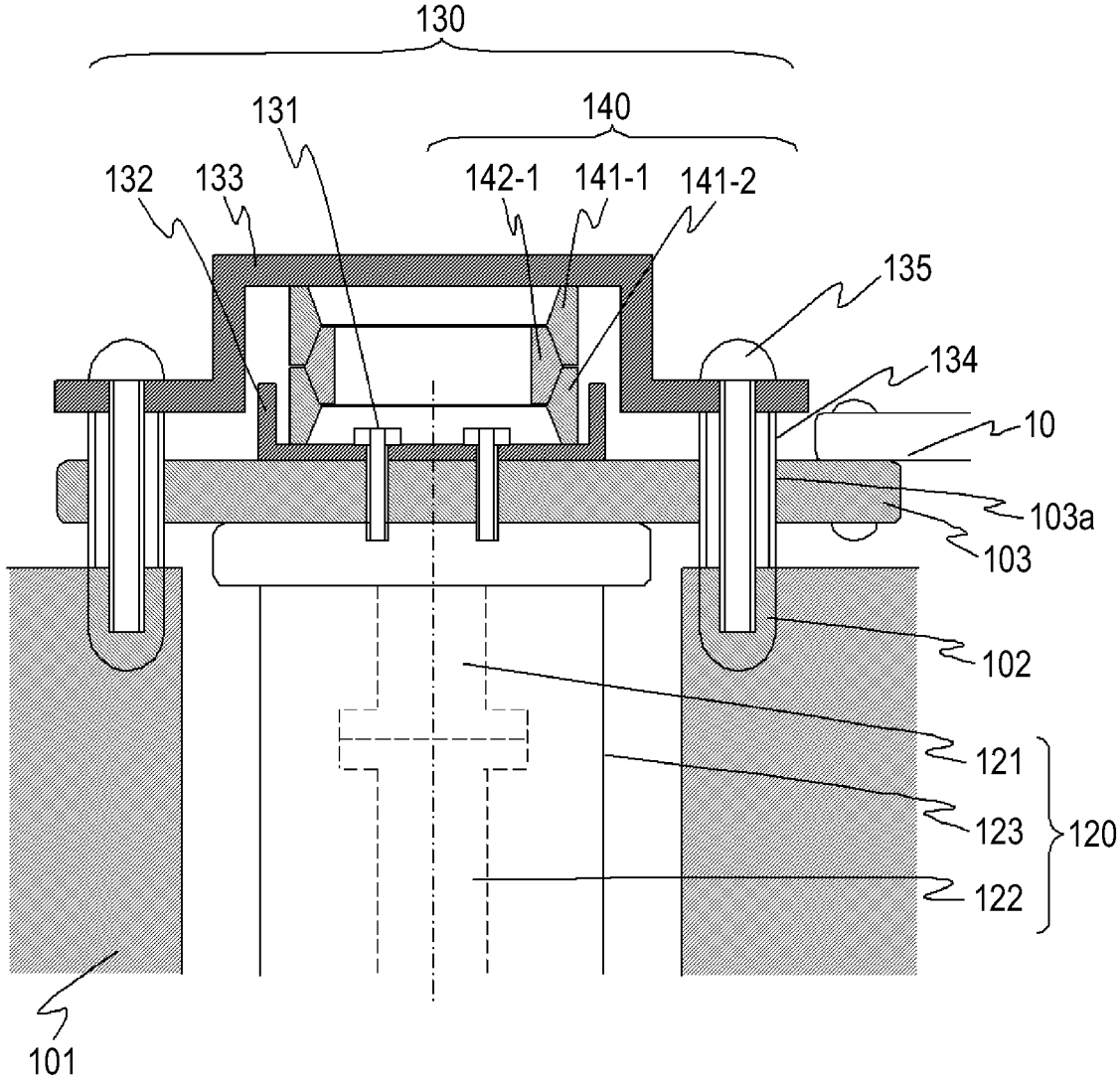
FIG. 4 is an enlarged sectional side view used to describe an operation of the fine motion mechanism according to one embodiment of the power breaker of the invention.

FIG. 3 and FIG. 4 are enlarged sectional side views showing a configuration of the fine motion mechanism 130 provided to the breaker 100 according to one embodiment of the invention. FIG. 3 shows a circuit open state and FIG. 4 shows a state immediately after a circuit closing operation.

Referring to FIG. 3, the fine motion mechanism 130 has a chattering suppression portion 140 formed by alternately stacking up plural ring members of different shapes. The chattering suppression portion 140 has a slope shape in a stacked portion of each ring member. The chattering suppression portion 140 absorbs kinetic energy generated upon collision due to a spring property developed by expansion and contraction in a radial direction and also a frictional force on the sloping surfaces against a compression force applied in an axial direction (a direction A). This absorption will be described more in detail below.

The chattering suppression portion 140 is placed on a lower stopper metal fitting 132 fixed to the supporting conductor 103 with bolts 131. In this state, the chattering suppression portion 140 is covered with an upper stopper metal fitting 133 from above and is therefore pinched between the lower stopper metal fitting 132 and the upper stopper metal fitting 133.

The upper stopper metal fitting 133 is fixed to inserts 102 embedded in the insulating frame 101 using bolts 135 while sandwiching guide tubes 134 in between. The supporting conductor 103 is provided in such a manner that holes 103*a* provided to the supporting conductor 103 are allowed to slide upward (the direction A) along the guide tubes 134.

The lower stopper metal fitting 132 fixed to the supporting conductor 103, the vacuum switch tube 123, and the fixed electrode 121 are also provided to be movable upward (the direction A) in association with the sliding of the supporting conductor 103. Hence, movements in a radial direction are suppressed.

Figure 5A:
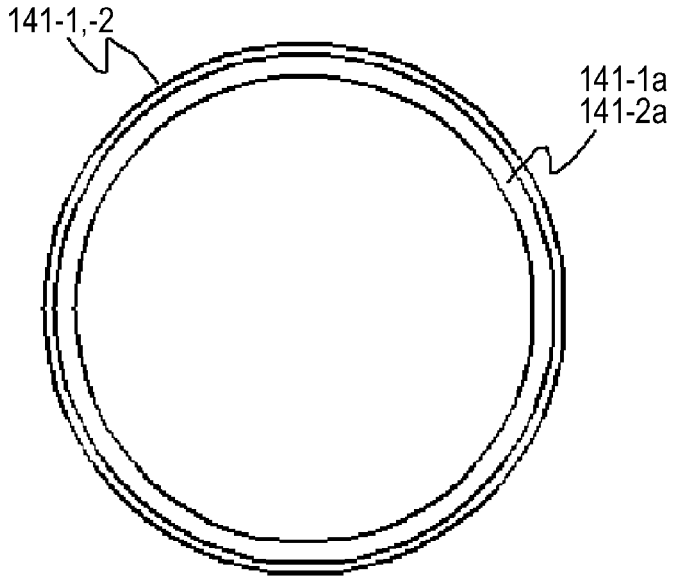
FIG. 5 is a drawing showing views of a configuration of ring members according to one embodiment of the power breaker of the invention.
Figure 5B:
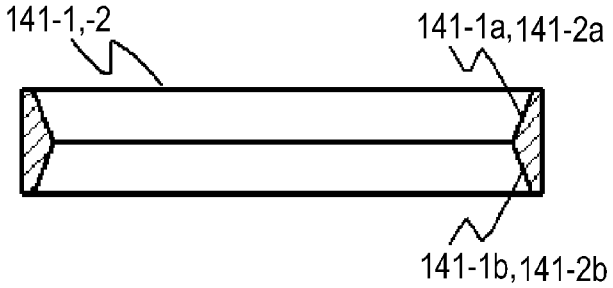
Figure 5C:
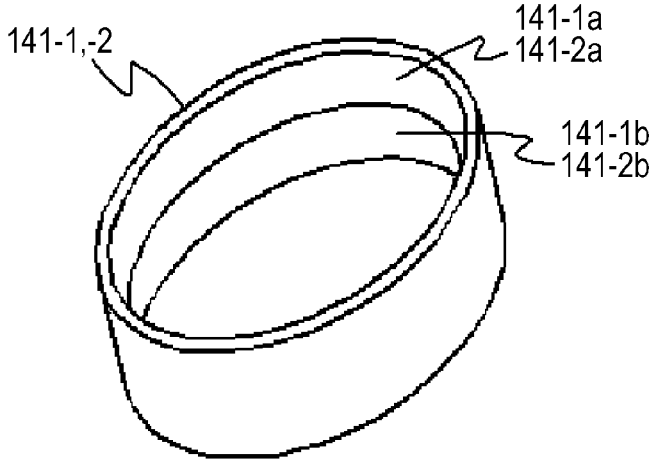
Figure 6A:
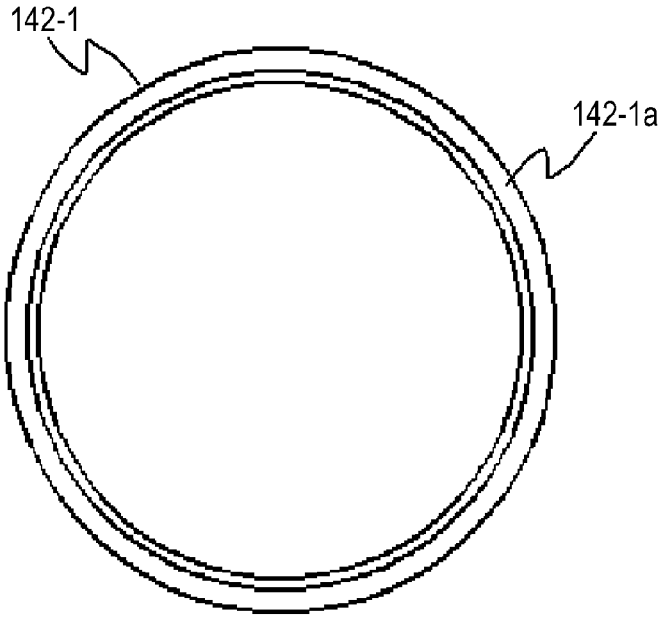
FIG. 6 is a drawing showing views of a configuration of a ring member according to one embodiment of the power breaker of the invention.
Figure 6B:
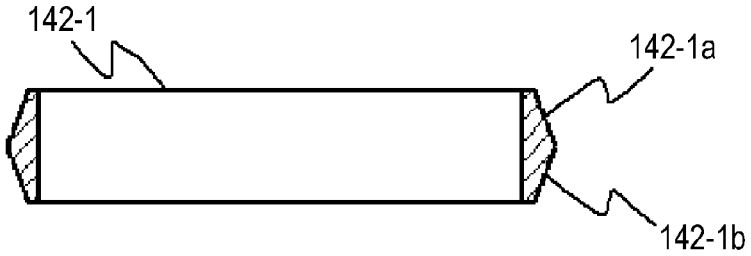
Figure 6C:
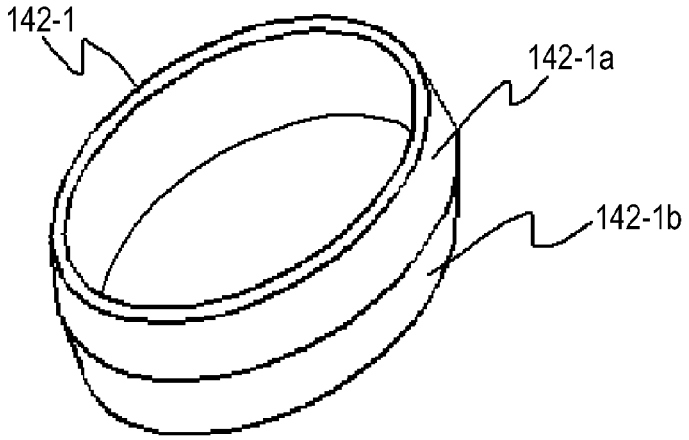

FIG. 5 and FIG. 6 show configurations of ring members 141-1 and 141-2 and a ring member 142-1, respectively, used in the chattering suppression portion 140 of the breaker 100 according to one embodiment of the invention. In FIG. 5 and FIG. 6, a top view, a sectional side view, and a perspective view are shown in (a), (b), and (c), respectively.

The ring members 141-1 and 141-2 are of the same shape, and as is shown in FIG. 5, have sloping surfaces 141-1*a* and 141-1*b* and sloping surfaces 141-2*a* and 141-2*b*, respectively, that are vertically symmetrical in the axial direction and form a convex portion of substantially a triangular shape on an inner peripheral surface side when viewed in cross section.

The ring member 142-1 has an outer peripheral shape different from that of the ring members 141-1 and 141-2, and is stacked between the ring members 141-1 and the ring member 141-2.

As is shown in FIG. 6, the ring member 142-1 has a sloping surface 142-1*a* and a sloping surface 142-1*b* that are vertically symmetrical in the axial direction and form a convex portion of substantially a triangular shape on an outer peripheral surface side when viewed in cross section.

The ring member 142-1, which is stacked between the ring members 141-1 and 141-2, has the sloping surface 142-1*a* and the sloping surface 142-1*b* provided correspondingly to the sloping surfaces 141-1*a* and 141-1*b* of the ring member 141-1, respectively, and to the sloping surfaces 141-2*a* and 141-2*b* of the ring member 141-2, respectively.

An outside diameter of the ring member 142-1 is determined in such a manner that a space between the ring member 141-1 and the ring member 141-2, where the ring member 142-1 is stacked, is maintained at a distance long enough for a spring property to be exerted sufficiently against a compression force in the axial direction.

The spring property of the chattering suppression portion 140 is controlled with a height, a diameter, a thickness in cross section, and an angle and a material of the sloping surfaces of the ring members 141-1, 142-1, and 141-2. Also, a frictional force of the chattering suppression portion 140 is controlled with a material and a surface condition of the sloping surfaces of the ring members 141-1, 142-1, and 141-2.

This embodiment has described a configuration in which the chattering suppression portion 140 is formed of three ring members. It should be appreciated, however, that the invention is not limited to this configuration. Herein, the spring property can be controlled by changing the number of the ring members.

Also, as a material of the ring members, hardened steel treated with surface polishing or hard chromium plating is preferable. It should be appreciated, however, that a material is not limited to this preferable example. Also, stacked portions are provided in the form of sloping surfaces; however, the stacked portions may be curved surfaces.

An operation of the chattering suppression portion 140 of the breaker 100 according to one embodiment of the invention will now be described using FIG. 3 and FIG. 4. Initially, when an operation to close a circuit in an open state shown in FIG. 3 is started, the movable electrode 122 is instantly pushed up in the direction A and comes into collision and contact with the fixed electrode 121.

Upon collision of the movable electrode 122 with the fixed electrode 121, an impact is transmitted to the chattering suppression portion 140 via the vacuum switch tube 123 and the supporting conductor 103. The chattering suppression portion 140 then absorbs the impact energy as kinetic energy.

More specifically, as is shown in FIG. 4, the supporting conductor 103 slides in the direction A along the guide tubes 134 against the spring property and a frictional force while compressing the ring members 141-1, 142-1, and 141-2 pinched between the lower stopper metal fitting 132 and the upper stopper metal fitting 133 in the direction A.

When compressed in the direction A, the sloping surfaces 142-1*a* and 142-1*b* of the ring member 142-1 are inserted wedgewise between the ring members 141-1 and 141-2, thereby causing the ring members 141-1 and 141-2 to expand in a radial direction. On the other hand, the ring member 142-1 is forced to contract in an inner radial direction by the corresponding sloping surfaces 141-1*a* and 141-2*b* of the ring members 141-1 and 141-2, respectively.

The chattering suppression portion 140 exerts the spring property owing to a force of the expanded ring members 141-1 and 141-2 that are trying to contract and a force of the compressed ring member 142-1 that is trying to expand.

In this manner, the chattering suppression portion 140 is capable of reducing a generation time of a chattering action by consuming kinetic energy generated upon collision of the movable electrode 122 with the fixed electrode 121 by energy absorption by friction due to the spring property of the ring members 141-1, 142-1, and 141-2 of their own and a frictional force on the sloping surfaces.

Also, even when the vacuum valve 120 tilts and moves in a radial direction when the circuit is closed, the chattering suppression portion 140 can exert the chattering action because the ring members follow up such motion in the same direction. As a larger number of the ring members are stacked up, the chattering suppression portion 140 exhibits abetter follow-up property.

Figure 7:
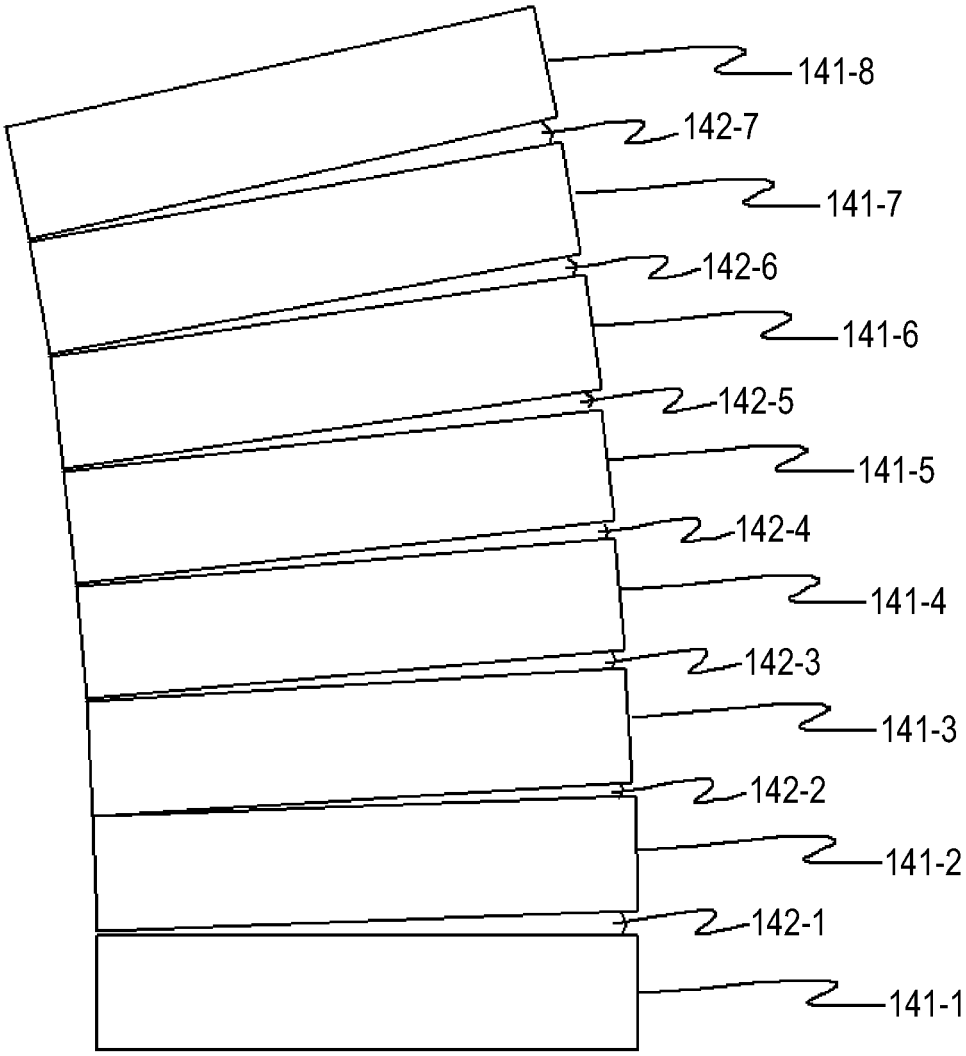
FIG. 7 is a view showing an example of an operation of the ring members according to one embodiment of the power breaker of the invention.

FIG. 7 is a side view of a chattering suppression portion in a follow-up state when 15 ring members are stacked up. In a case where the vacuum valve 120 tilts and moves in a radial direction, the ring members 141-1, 141-2, . . . , and 141-8 and the ring members 142-1, 142-2, . . . , and 142-7 stacked up alternately follow up this motion as is shown in FIG. 7.

As has been described, according to this embodiment, the fine motion mechanism portion 130 has the chattering suppression portion 140 formed of the ring members 141-1 and 141-2 and the ring member 142-1 provided with the sloping surfaces or the curved surfaces at positions corresponding to one another in a state stacked up in a center axis direction, so that an impact generated upon collision of the movable electrode 122 with the fixed electrode 121 when the circuit is closed is trapped as a compression force. Hence, kinetic energy generated upon collision is consumed by energy absorption by friction due to the spring property developed by contraction and expansion of the ring members in a radial direction and a frictional force on the contact surfaces. It thus becomes possible to reduce a generation time of a chattering action. In addition, it becomes possible to suppress chattering with a simple, compact, and inexpensive configuration.

Further, even when the vacuum valve 120 tilts and moves in a radial direction when the circuit is closed, the chattering action can be exerted owing to the ring members that follow up this motion.

The spring property of the chattering suppression portion 140 can be readily controlled by selecting a height, a diameter, a thickness in cross section, the number of ring members to be stacked up, and an angle and a material of the sloping surfaces of the ring members 141-1, 141-2, and 142-1.

Also, a frictional force of the chattering suppression portion 140 can be readily controlled by selecting a material and a surface condition of the sloping surfaces of the ring members 141-1, 141-2, and 142-1.

The ring members used in this embodiment are those having a convex portion of substantially a triangular shape on the inner peripheral surface side or the outer peripheral surface side when viewed in cross section. It should be appreciated, however, that the ring members are not limited to this example. For example, FIG. 8 shows another configuration according to one embodiment of the invention, and sectional side views of ring members 151-1 and 151-2 and of a ring member 152-1 are shown in (a) and (b), respectively.

Figure 8A:
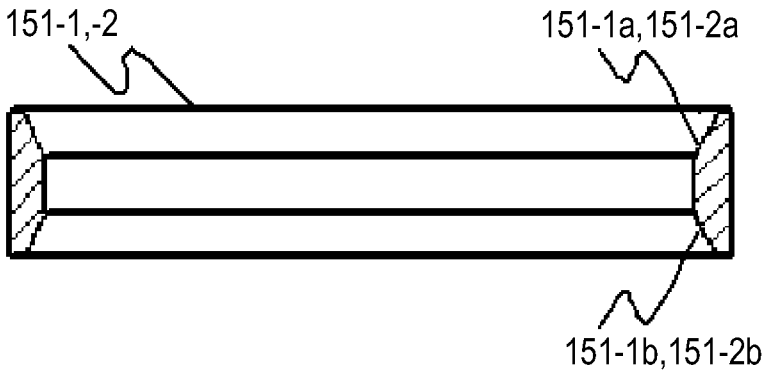
FIG. 8 is a view showing cross sections of another configuration of the ring members according to one embodiment of the power breaker of the invention.
Figure 8B:
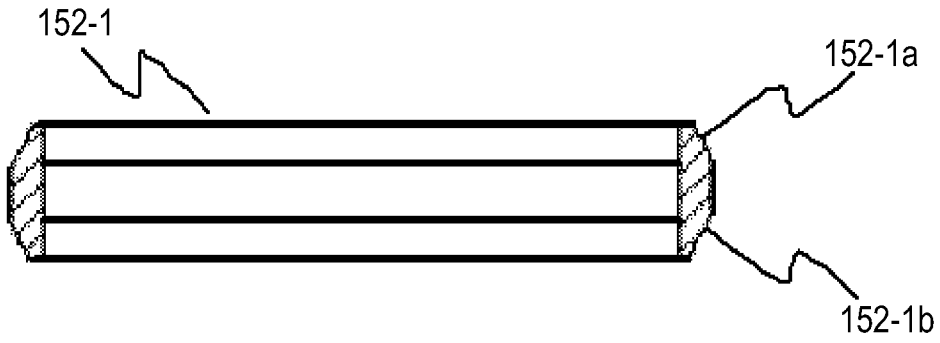

As is shown in FIG. 8, the ring members 151-1, 151-2, and 152-1 may have a convex portion of substantially a trapezoidal shape on the inner peripheral surface side or the outer peripheral surface side when viewed in cross section. The same advantage can be achieved in this case, too.

Figure 9A:
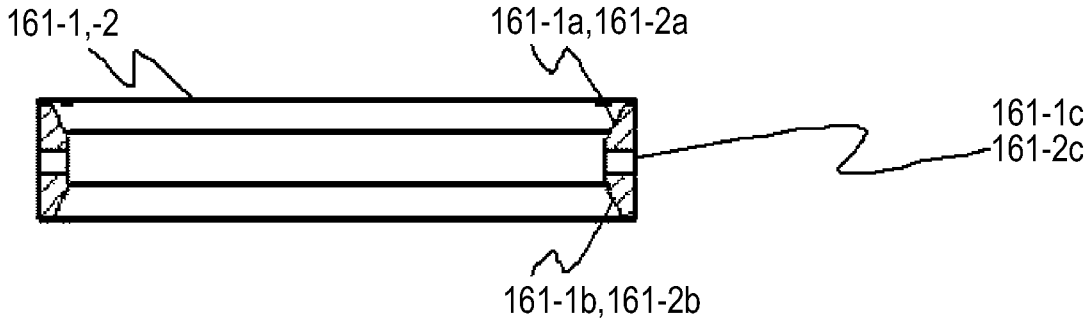
FIG. 9 is a view showing cross sections of still another configuration of the ring members according to one embodiment of the power breaker of the invention.
Figure 9B:
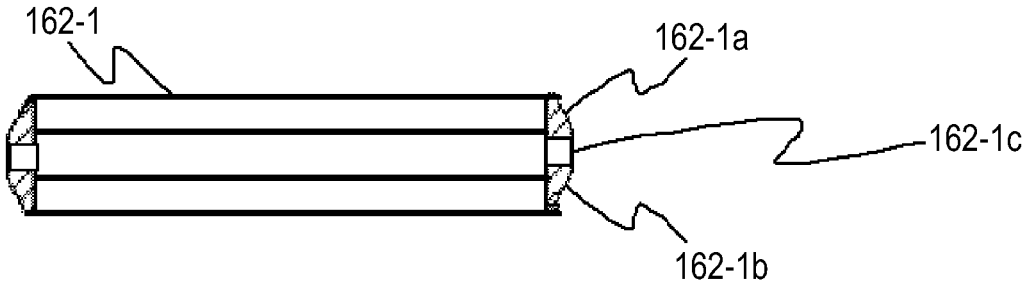

Also, FIG. 9 shows sectional side views of another configuration according to one embodiment of the invention, and ring members 161-1 and 161-2 and a ring member 162-1 are shown in (a) and (b), respectively.

As is shown in FIG. 9, the ring members 161-1, 161-2, and 162-1 are of a structure provided with holes 161-*c*, 161-1*c*, and 162-1*c*, respectively, in a radial direction of the rings. In this case, the spring property of the rings can be controlled by selecting the number and shapes of the holes 161-*c*, 161-2*c*, and 162-1*c*.

Figure 10:
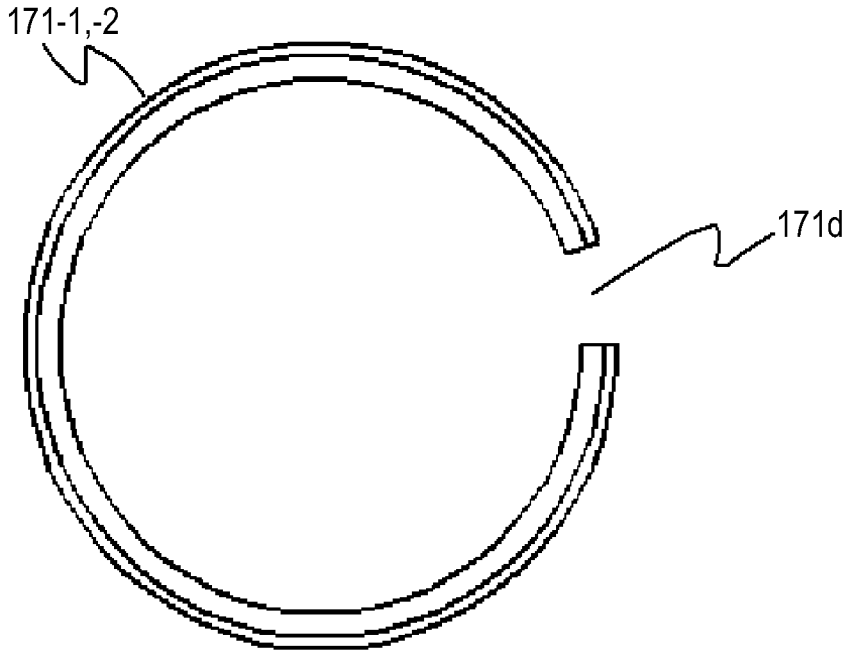
FIG. 10 is a cross section showing still another configuration of the ring members according to one embodiment of the power breaker of the invention.

FIG. 10 is a top view of ring members 171-1 and 171-2 as still another configuration according to one embodiment of the invention.

As is shown in FIG. 10, the ring members 171-1 and 171-2 are of a structure provided with slits 171-1*d* and 171-2*d*, respectively, in part of the rings. In this case, the spring property of the rings can be controlled by selecting a width of the slits 171-1*d* and 171-2*d*.

It goes without saying that the same advantage can be achieved by providing a slit 172-1*d* to a ring member 172-1 (not shown) sandwiched between the ring members 171-1 and 171-2.

Figure 11A:
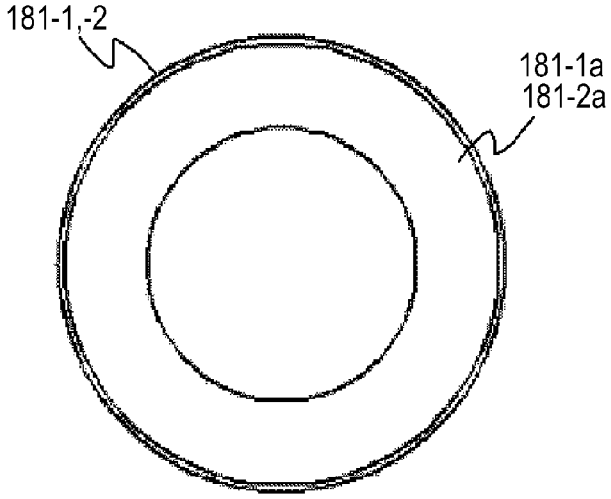
FIG. 11 is a view showing cross sections of still another configuration of the ring members according to one embodiment of the power breaker of the invention.
Figure 11B:
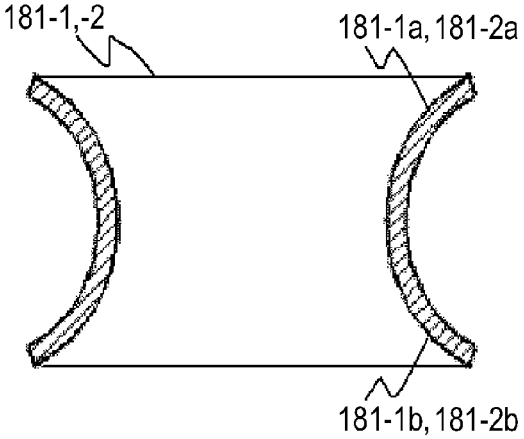
Figure 11C:
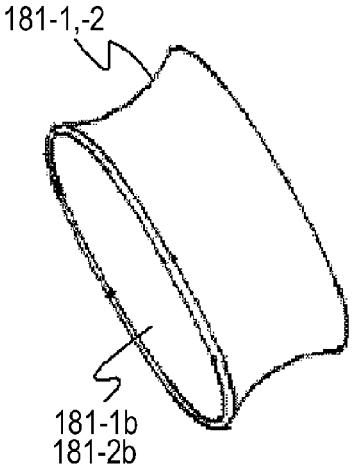
Figure 12A:
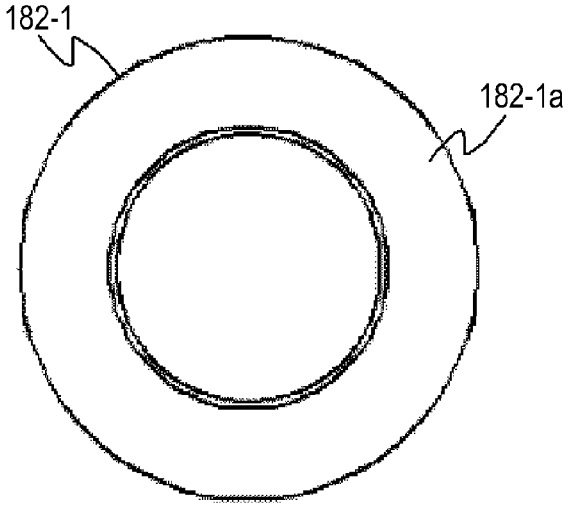
FIG. 12 is a view showing cross sections of still another configuration of the ring member according to one embodiment of the power breaker of the invention.
Figure 12B:
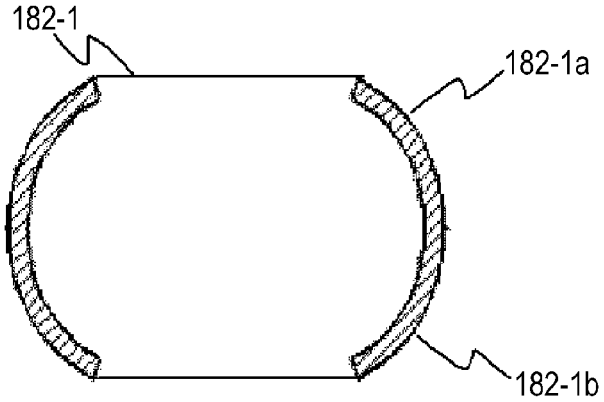
Figure 12C:
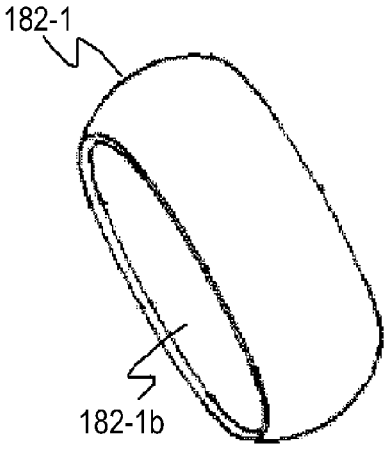

Also, FIG. 11 and FIG. 12 show ring members 181-1 and 181-2 and a ring member 182-1, respectively, as still another configuration according to one embodiment of the invention. In FIG. 11 and FIG. 12, a top view, a sectional side view, and a perspective view are shown in (a), (b), and (c), respectively.

As are shown in FIG. 11 and FIG. 12, the ring members 181-1, 181-2, and 182-1 are formed of plate-like members having a vertically symmetrical curved surface or sloping surface when viewed in cross section. In this case, it becomes possible to form the ring members easily at a low cost by a manufacturing method, such as pressing.

DESCRIPTION OF NUMERAL REFERENCES AND SIGNS

15: breaker operation mechanism
100: breaker
101: insulating frame
121: fixed electrode
122: movable electrode
124: operation rod conductor
130: fine motion mechanism portion
140: chattering suppression portion
141-1 and 141-2: ring member
141-1*a*, 141-1*b*, 141-2*a*, 141-2*b*: sloping surface
142-1: a ring member
142-1*a* and 142-1*b*: sloping surface

The invention claimed is:

1. A power breaker, comprising:

a switch portion formed of a fixed electrode and a movable electrode provided so that the movable electrode is allowed to come into contact with and separate from the fixed electrode;

a movable shaft extending from the movable electrode;

an operation mechanism closing and opening the switch portion by driving the movable shaft;

a frame holding the switch portion and the movable shaft inside; and a fine motion mechanism provided with a chattering suppression portion formed of two or more separate ring members in contact with each other on sloping surfaces or curved surfaces formed at positions corresponding to each another in a state stacked up in a central axis direction and formed in a driving direction of the movable electrode on a side of a surface of the fixed electrode fixed to the frame opposite to a surface with and from which the movable electrode comes into contact and separates, and trapping a force generated upon collision of the movable electrode with the fixed electrode during a circuit closing operation in the chattering suppression portion as a compression force due to a spring property of the ring members and a frictional force on the sloping surfaces or curved surfaces.

2. The power breaker according to claim 1, wherein:

the chattering suppression portion is formed by stacking up a ring member of said two or more ring members having a sloping surface or a curved surface on an inner peripheral surface side when viewed in cross section and a ring member of said two or more ring members having the sloping surface or the curved surface on an outer peripheral surface side.

3. The power breaker according to claim 2, wherein:

the ring members each are formed of a plate-like member.

4. The power breaker according to claim 2, wherein:

the ring members each have a convex portion of substantially a triangular shape on the inner peripheral surface side or the outer peripheral surface side when viewed in cross section.

5. The power breaker according to claim 2, wherein:

the ring members each have a convex portion of substantially a trapezoidal shape on the inner peripheral surface side or the outer peripheral surface side when viewed in cross section.

6. The power breaker according to claim 1, wherein:

the ring members each are provided with a hole in a radial direction.

7. The power breaker according to claim 1, wherein:

the ring members each are provided with a slit.

* * * * *